US007686479B2

(12) United States Patent
Yang et al.

(10) Patent No.: US 7,686,479 B2
(45) Date of Patent: Mar. 30, 2010

(54) LED FLAT-PLATE TYPE MULTI-CHIP HIGH POWER LIGHT SOURCE

(75) Inventors: Xianghong Yang, Honghu (CN); Baoyan Chang, Guangdong (CN); Zheng Xu, Honghu (CN)

(73) Assignee: Shenzhen Hongya Opto Electronic Co., Ltd., Shenzhen, Guangdong (CN)

( * ) Notice: Subject to any disclaimer, the term of this patent is extended or adjusted under 35 U.S.C. 154(b) by 0 days.

(21) Appl. No.: 12/043,367

(22) Filed: Mar. 6, 2008

(65) Prior Publication Data

US 2009/0010009 A1 Jan. 8, 2009

(30) Foreign Application Priority Data

Jul. 6, 2007 (CN) ..... 2007 1 0075903

(51) Int. Cl.
*F21V 29/00* (2006.01)

(52) U.S. Cl. ..... 362/294; 362/373; 362/97.3; 257/98; 257/99

(58) Field of Classification Search ..... 362/227, 362/238, 240, 294, 341, 350, 516, 545, 547, 362/800; 257/98–100, 678, 782
See application file for complete search history.

(56) References Cited

U.S. PATENT DOCUMENTS

| | | | | |
|---|---|---|---|---|
| 4,733,335 | A * | 3/1988 | Serizawa et al. | 362/503 |
| 6,480,389 | B1 * | 11/2002 | Shie et al. | 361/707 |
| 7,102,213 | B2 * | 9/2006 | Sorg | 257/667 |
| 7,401,960 | B2 * | 7/2008 | Pond et al. | 362/545 |
| 7,435,997 | B2 * | 10/2008 | Arndt et al. | 257/98 |
| 2007/0297167 | A1 * | 12/2007 | Greenhoe | 362/183 |

* cited by examiner

*Primary Examiner*—Hargobind S Sawhney
(74) *Attorney, Agent, or Firm*—Jackson IPG PLLC

(57) ABSTRACT

The present invention provides a LED flat-plate type multi-chip high power light source comprising a heat dissipating substrate, a reflecting cover mounted on the heat dissipating substrate, a circuit board embedded in the heat dissipating substrate, LEDs mounted on the circuit board and in the reflecting cover, and the circuit board also connecting to a socket set in the heat dissipating substrate. The heat dissipating substrate is made of high heat conduction metal. In the present invention, the heat dissipating substrate is made of high heat conduction metal, and the heat conducting pole is abolished. Comparing with the conventional art, the present invention decreases the heat dissipating path, increases the sectional area, and eliminates the intermediate link of high thermal resistance.

5 Claims, 2 Drawing Sheets

LED FLAT-PLATE TYPE MULTI-CHIP HIGH POWER LIGHT SOURCE

RELATED APPLICATIONS

The present application is based on, and claims priority from, China Application Number 200710075903.6, filed Jul. 6, 2007, the disclosure of which is hereby incorporated by reference herein in its entirety.

BACKGROUND OF THE INVENTION

1. Field of the Invention

The present invention relates to an illuminating device, particularly relates to a high power LED light source.

2. Description of the Related Art

As a new type of light source, LED gradually concerns all the countries in the world. Comparing with the traditional light source, LED involves the advantages: 1, having better safety, belonging to cold light source device, being driven in low voltage, having firm structure, not falling to pieces; having long useful life, lasting 50-100 thousand hours in a good heat dissipation condition, which is much longer than other light sources; 2, having rich colors, being regulated and controlled easily; 3, improving luminous efficiency greatly year after year, the general products achieving 60-801 m/w now, which is much better than incandescent lamps of 301 m/w, equaling 801 m/w of fluorescent lamp with best luminous efficiency, and to exceed the luminous efficiency of other light sources is just a matter of time; 4, protecting the environment, having no heavy metal pollutions in waste materials, according with the standard of EU ROSH.

As a semiconductor device, LED has the inherent disadvantage of not enduring heat. Especially for the high power device, if failed to conduct and emit the heat generated in working, the temperature of the PN junction will rise leading to the great dropping in luminous efficiency; if the temperature of the PN junction is over 120° C., with time passing by unrecoverable attenuation of light or even dying of the lamp will occur, and it is very common that after 1000 hours the brightness will decrease over 50%. A familiar LED light source structure, as illustrated in FIG. 1, comprises a chip bonding plane 01, a heat conducting pole 02, a heat dissipating substrate 03, and a user radiator 04. The structure comprises disadvantages that sectional area of the heat conducting pole 02 is small, the heat conducting path is long, and the thermal resistance is great. Commonly, silicone 05 is used to connect between the heat conducting pole 02 and the heat dissipating substrate 03, even if tin-lead solders were used, that will become a big thermal resistance region. For the thermal resistance is great, the structure can only conduct limited heat. So with the structure, only 1-3 W light source can be produced, and the light source of above 5 W will have short useful life due to absence of conducting heat.

In the mean time, conventional high power LED lamps usually use a metal shell as a radiator. If the power supply wire is led out from the inverse of the heat dissipating substrate, it can only be settled in the following two ways; 1, using a metal block thicker than the length of the lead wire as a transition between the heat dissipating substrate and the radiator, which will bring the thermal resistance and thermal accumulate to increase; 2, drilling and making insulation on the shell of the lamps, which will introduce problems of both appearance and waterproofness. So, setting the lead wire at the inverse of the heat dissipating substrate neither is convenient to fix, nor can make the combined area of the heat dissipating substrate and the user radiator up to 100%, which will weaken the heat dissipating effect.

SUMMARY OF THE INVENTION

The present invention provides a LED flat-plate type multi-chip high power light source with good heat dissipating capability, with the heat dissipating substrate being capable of completely combining with the user radiator, to solve the technical problem that the conventional LED lamps have bad heat dissipating capability and can not afford the high power LED to dissipate heat.

To solve the above said problem, the technical solution of the present invention is to construct a LED flat-plate type multi-chip high power light source comprising a heat dissipating substrate, a reflecting cover mounted on the heat dissipating substrate, a circuit board embedded in the heat dissipating substrate, LEDs mounted on the circuit board and in the reflecting cover, and the circuit board also connecting to a socket set in the heat dissipating substrate.

The said circuit board has a circle shape; on the heat dissipating substrate, a circle shape groove matching the shape of the circuit board is provided; on the heat dissipating substrate, a jamming groove opened from the side wall of the heat dissipating substrate to the circle shape groove is provided; the socket is fixed into the jamming groove.

The said reflecting cover has a circle shape, and the internal wall of the reflecting cover is an arc shape bevel, at its bottom provided with an inner groove; the reflecting cover is also provided with a gap matching the shape of the socket and corresponding to the jamming groove; the circle shape groove is on the heat dissipating substrate under the inner groove.

The said heat dissipating substrate is provided with a number of LED groups, and each LED group is formed by LEDs being arranged in a line or in a "V" shape; the LEDs of each group are connected to each other in series and then connected to the circuit board.

The said heat dissipating substrate is made of high heat conduction metal.

In the present invention, the heat dissipating substrate is made of high heat conduction metal, and the heat conducting pole is abolished. Comparing with the conventional art, the present invention decreases the heat dissipating path, increases the sectional area, and eliminates the intermediate link of high thermal resistance. At the same time, by means of embedding the circuit board into the heat dissipating substrate, the electrodes are directly formed on the circuit board to connect among the LED groups, and finally the power supply wire is led out through the socket. The situation of fixing the socket gets the combined area of the inverse of the heat dissipating substrate and the user radiator up to 100%, decreasing the thermal resistance effectively, and avoiding the problem of influencing the whole heat dissipating effect by using a metal block as a transition, and avoiding the problem of waterproofness and the lamps' absence of beauty introduced by drilling on the heat dissipating substrate. The present invention increases the power of a single light source, decreases the attenuation of light greatly, increases the useful life greatly, and makes the LED being used in high power illuminating area.

Other objects, advantages and novel features of the present invention will be drawn from the following detailed embodiment of the present invention with attached drawings, in which:

DESCRIPTION OF THE PREFERRED EMBODIMENT

Figure 1:
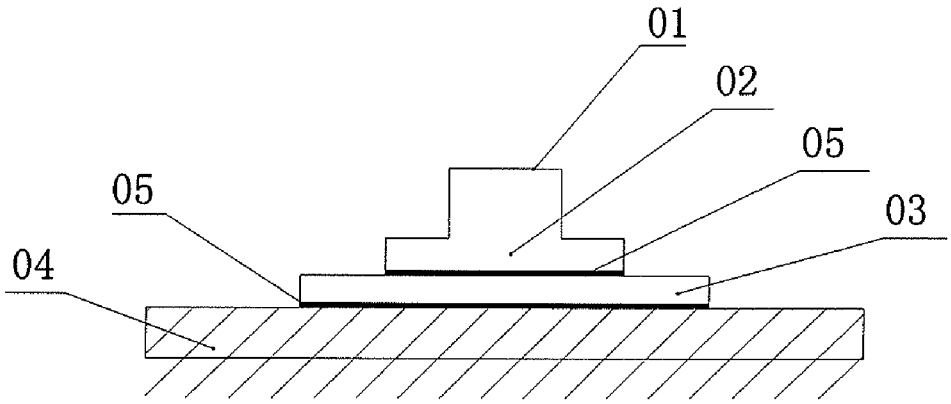
FIG. 1 is a structure schematic diagram of a conventional LED lamp.
Figure 2:
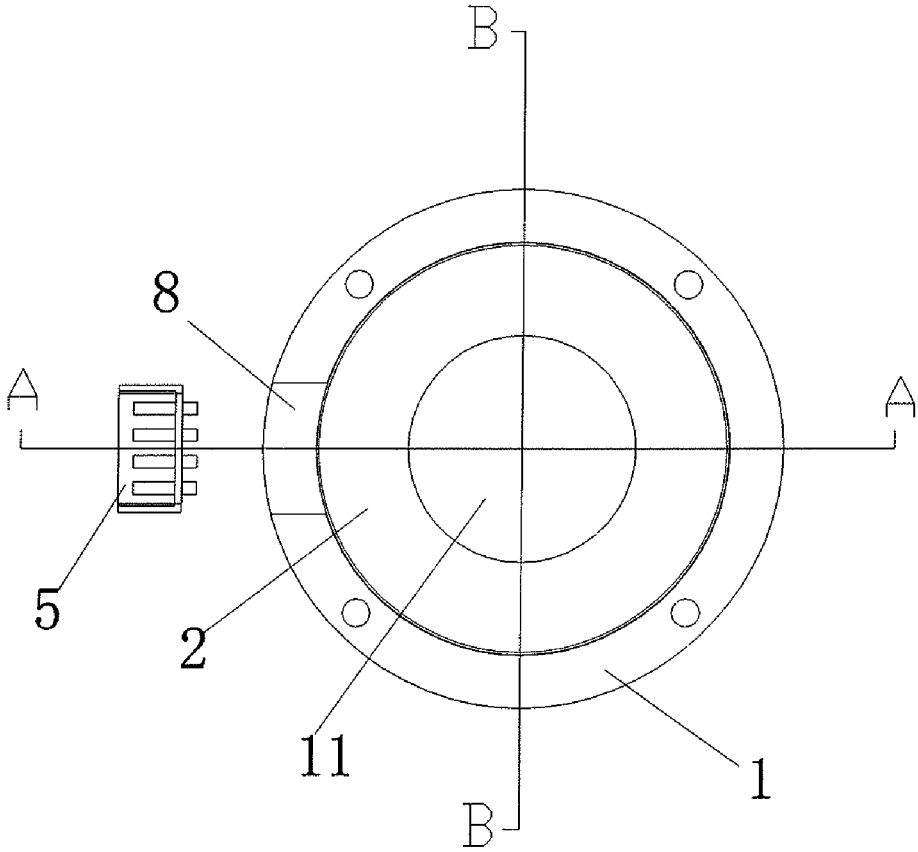
FIG. 2 is a front view of a preferred embodiment of the present invention.
Figure 3:
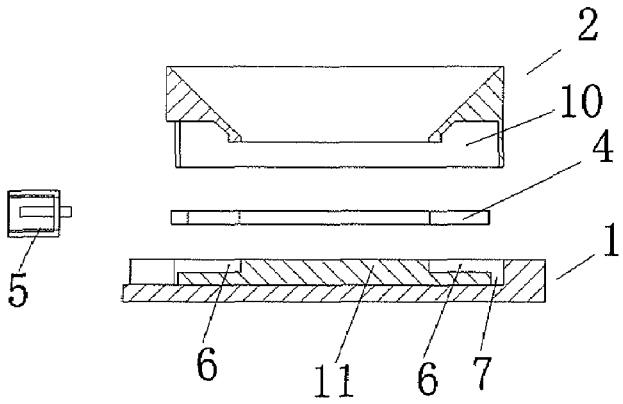
FIG. 3 is a sectional view of FIG. 2 along the line A-A.

FIG. 2 and FIG. 3 illustrate the basic structure of a preferred embodiment of the present invention. The LED flat-plate type multi-chip high power light source comprises a heat dissipating substrate 1, a reflecting cover 2 mounted on the heat dissipating substrate 1, a circuit board 4 embedded in the heat dissipating substrate 1, LEDs 3 mounted on the circuit board 4 and in the reflecting cover 2, and the circuit board 4 also connecting to a socket 5 set in the heat dissipating substrate 1. The heat dissipating substrate 1 is made of high heat conduction metal, to ensure the heat dissipating substrate 1 to have the capability of good heat conduction and dissipating.

Figure 4:
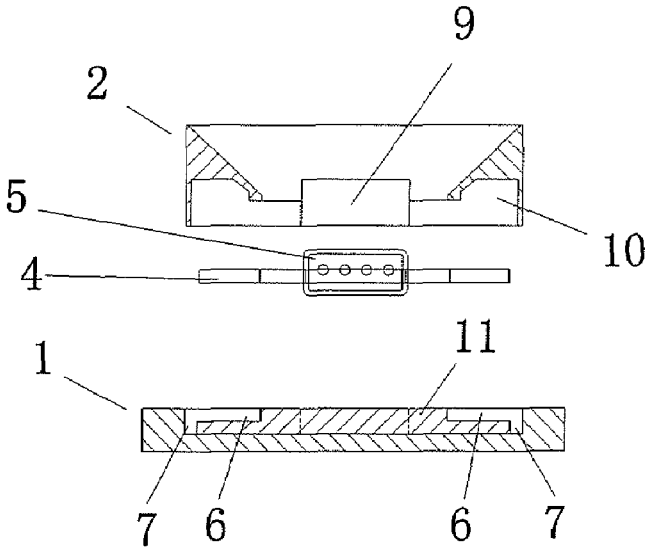
FIG. 4 is a sectional view of FIG. 2 along the line B-B.
Figure 5A:
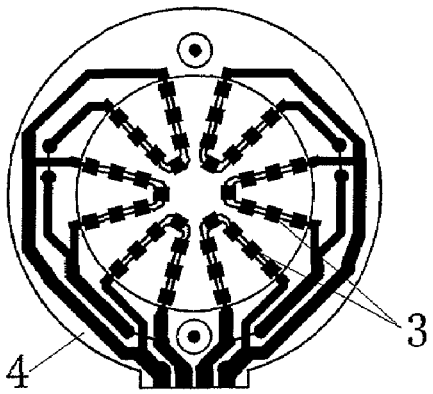
FIG. 5A and FIG. 5B are schematic diagrams of the LED connection in a preferred embodiment of the present invention.
Figure 5B:
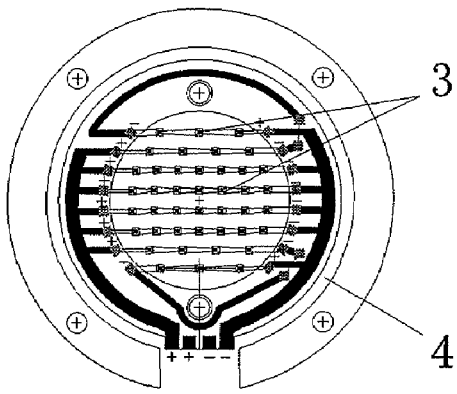

As shown in FIG. 4, the heat dissipating substrate 1 has a round shape, and the circuit board 4 embedded in the heat dissipating substrate 1 has a circle shape. On the heat dissipating substrate 1, a circle shape groove 6 matching the shape of the circuit board 4 is provided; outside the circle shape groove 6, a circle shape trench groove 7 deeper than the circle shape groove 6 is provided; the circuit board 4 is embedded into the circle shape groove 6 when assembling. At the same time, to get the combined area of the inverse of the heat dissipating substrate and the user radiator up to 100%, on the heat dissipating substrate 1, a jamming groove 8 opened from the side wall of the heat dissipating substrate 1 to the circle shape groove 6 is provided. When assembling, the socket 5 is embedded in the jamming groove 8 to be fixed, and meanwhile the socket 5 is welded to the circuit board 4. The circle shape trench groove 7 makes a truncated cone 11 formed in the middle of the heat dissipating substrate 1. The LEDs 3 on the truncated cone 11 is arranged in two ways; one way is that LEDs of each group are arranged in a "V" shape, and every group of LEDs is arranged in a circle in turn (referring to FIG. 5A); another way is that LEDs of each group are arranged in a line, and every group of LEDs is arranged in an array in turn (referring to FIG. 5B). The LEDs of each group are connected to each other in series and then connected to the circuit board 4.

By means of embedding the circuit board 4 into the heat dissipating substrate 1, the electrodes are directly formed on the circuit board 4 to connect among the LEDs 3 chip groups, and then the power supply wire is led out through the socket 5. The situation of fixing the socket 5 gets the combined area of the inverse of the heat dissipating substrate and the user radiator up to 100%, avoiding the problem of influencing the whole heat dissipating effect by using a metal block as a transition and the problem of waterproofness introduced by drilling on the heat dissipating substrate.

As shown in FIG. 3, FIG. 4, the reflecting cover 2 has a circle shape, at its bottom provided with an inner groove 10 matching the circle shape groove 6. The shell of the reflecting cover 2 matches the circle shape trench groove 7 on the heat dissipating substrate 1. As assembling, the bottom of the shell of the reflecting cover 2 is embedded into the circle shape trench groove 7, to fixing the reflecting cover 2 on the heat dissipating substrate 1. After fixing the reflecting cover 2, the circle shape groove 6 is under the inner groove 10, and the circle shape circuit board hides under the reflecting cover 2, which makes the LED lamp more beautiful. After fixing the reflecting cover 2 on the heat dissipating substrate 1, the middle hole of the reflecting cover 2 matches the truncated cone 11, which the diameter of the middle hole of the reflecting cover 2 need to be nearly equal to that of the truncated cone 11. In the present embodiment, the internal wall of reflecting cover 2 slants in an angle, making the internal wall of the reflecting cover 2 to form a reflecting surface of an arc shape bevel; the reflecting cover 2 is also provided with a gap 9 matching the shape of the socket 5 and corresponding to the jamming groove 8; after fixing the reflecting cover 2 on the heat dissipating substrate 1, the socket 5 is jammed into the gap 9 and jamming groove 8 at the same time, the gap 9 and the jamming groove 8 being connected and combined to each other.

In the present invention, the heat dissipating substrate is made of high heat conduction metal, and the heat conducting pole is abolished. Comparing with the conventional art, the present invention decreases the heat dissipating path, increases the sectional area, and eliminates the intermediate link of high thermal resistance. The present invention increases the power of a single light source (the present structure increases the power from conventional below 5 W to 30 W-200 W), decreases the attenuation of light greatly (below 5% for 1000 hours), increases the useful life greatly (more than 20000 hours), and makes the LED being used in high power illuminating area.

What is claimed is:

1. A LED flat-plate type multi-chip high power light source comprising a heat dissipating substrate, a reflecting cover mounted on the heat dissipating substrate, a circuit board embedded in the heat dissipating substrate, LEDs mounted on the circuit board and in the reflecting cover, and the circuit board also connecting to a socket set in the heat dissipating substrate, wherein the said circuit board has a circle shape; on the said heat dissipating substrate, a circle shape groove matching the shape of the circuit board is provided; on the heat dissipating substrate, a jamming groove opened from the side wall of the heat dissipating substrate to the circle shape groove is provided; the said socket configured to be fixed into the said jamming groove.

2. The LED flat-plate type multi-chip high power light source of claim 1, wherein the said reflecting cover has a circle shape, and the internal wall of the reflecting cover is an arc shape bevel, at its bottom provided with an inner groove; the said reflecting cover is also provided with a gap matching the shape of the said socket and corresponding to the said jamming groove; the said circle shape groove is on the said heat dissipating substrate under the said inner groove.

3. The LED flat-plate type multi-chip high power light source of claim 2, wherein the said heat dissipating substrate is provided with a number of LED groups, and each LED group is formed by LEDs being arranged in a "V" shape; every LED group is arranged in a circle in turn; the LEDs of each group are connected to each other in series and then connected to the circuit board.

4. The LED flat-plate type multi-chip high power light source of claim 3, wherein the said heat dissipating substrate is provided with a number of LED groups, and each LED group is formed by LEDs being arranged in a line; every LED group is arranged in an array in turn; the LEDs of each group are connected to each other in series and then connected to the circuit board.

5. The LED flat-plate type multi-chip high power light source of claim 1, wherein the said heat dissipating substrate is made of high heat conduction metal.

* * * * *